United States Patent [19]

Hongo et al.

[11] Patent Number: 4,471,627

[45] Date of Patent: Sep. 18, 1984

[54] LOW-TEMPERATURE LIQUEFIED GAS OUTFLOW DEVICE

[75] Inventors: Akira Hongo, Miki; Hideki Ueda, Nagoya; Issei Nakata, Shizuoka; Eiichi Yoshida, Shimizu; Nobuyoshi Aoki, Shimizu; Toshimitsu Suzuki, Shimizu, all of Japan

[73] Assignee: Teisan Kabushiki Kaisha & Daiwa Can Co., Ltd., Tokyo, Japan

[21] Appl. No.: 485,010

[22] Filed: Apr. 14, 1983

[30] Foreign Application Priority Data

Apr. 22, 1982 [JP] Japan ..... 57-67671

[51] Int. Cl.[3] ..... F17C 13/02

[52] U.S. Cl. ..... 62/49; 62/51; 62/514 R

[58] Field of Search ..... 62/45, 49, 50, 51, 55, 62/514 R

[56] References Cited

U.S. PATENT DOCUMENTS 3,938,347 2/1976 Riedel et al. ..... 62/55

4,059,424 11/1977 Bentz ..... 62/49

*Primary Examiner*—Ronald G. Capossela

*Attorney, Agent, or Firm*—James E. Nilles

[57] ABSTRACT

A low-temperature liquefied gas outflow device wherein an outflow nozzle having a plurality of through-holes is provided through the base of a heat-insulating container having an opening at the top, and a cover member closing the opening, a control device for selectively opening or closing any desired number of the plurality of through-holes provided in the outflow nozzle is provided. The heat-insulating container has a level sensor located within the heat-insulating container, a liquefied gas supply conduit running through the cover member, a vaporized-gas exhaust conduit provided in the cover member, and a check valve inserted into the liquefied gas supply conduit, operating in response to a signal from the level sensor. The control device for selectively opening or closing the through-holes comprises a plurality of valve elements for selectively closing the through-holes, and an elevation cylinder for controlling the operation of the plurality of valve elements. The plurality of valve elements are arranged concentrically with each other, or arranged separately in the horizontally direction from each other.

12 Claims, 3 Drawing Figures

LOW-TEMPERATURE LIQUEFIED GAS OUTFLOW DEVICE

BACKGROUND OF THE INVENTION

1. Field of the Invention

The present invention relates to a low-temperature liquefied gas outflow device, and more particularly to a low-temperature liquefied gas outflow device which can control the flow rate of a low-temperature liquefied gas such as liquid nitrogen.

2. Description of the Prior Art

There are many fields in which it is necessary to provide a flow of low-temperature liquefied gas at an accurately constant rate.

In general, low-temperature liquefied gas is naturally of a high vaporability, and once vaporization occurs, the resultant gas mixes with the liquefied gas. Thus it is difficult to maintain an accurate flow of low-temperature liquefied gas at a constant rate. Accordingly it is desirable that such a low-temperature liquefied gas should be prevented from evaporation so that the liquefied gas flow is completely liquid.

Particularly when using a liquefied gas flow in the liquid state, it is desirable to minimize the evaporation of the liquefied gas even after it has flowed out of the outflow device.

In prior art outflow devices, a single through-hole is provided in a nozzle and the surface area of the low-temperature liquefied gas flowing out of the nozzle through-hole is made to be as small as possible.

In such a prior art outflow device, if the pressure inside the device is constant, for example if it is at atmospheric pressure, the outflow rate is determined by the liquid level (head) and the diameter of the nozzle hole. Accordingly, when both of the liquid level and nozzle hole diameter are fixed, the only control that be effected on the outflow rate of liquefied gas is the insertion of the tip of a needle valve into the nozzle hole so that the opening of the hole is adjusted by the degree of insertion of the needle valve.

This control is, however, very difficult with a nozzle hole having a relatively small diameter. Thus, the prior art outflow device cannot meet the requirement of varying the outflow rate readily according to its various uses.

SUMMARY OF THE INVENTION

An object of the present invention is to provide a low-temperature liquefied gas outflow device which removes the above defects and enables an effective control of the outflow rate of low-temperature liquefied gas.

The low-temperature liquefied gas outflow device according to the present invention is characterized by comprising a heat-insulating container having an opening at the top, a cover member closing the opening, an outflow nozzle having a plurality of through-holes which runs through the base of the heat-insulating container, a control mechanism which selectively opens or closes any desired number of the plurality of through-holes provided in the outflow nozzle, a level sensor located within the heat-insulating container, a liquefied gas supply conduit running through the cover member, a vaporized-gas exhaust conduit provided in the cover member, and a check valve inserted into the liquefied gas supply conduit, operating in response to a signal from the level sensor.

The other objects and advantages of the present invention will be apparent from the description taken in conjunction with the accompanying drawings, in which:

DESCRIPTION OF THE PREFERRED EMBODIMENTS

Figure 1:
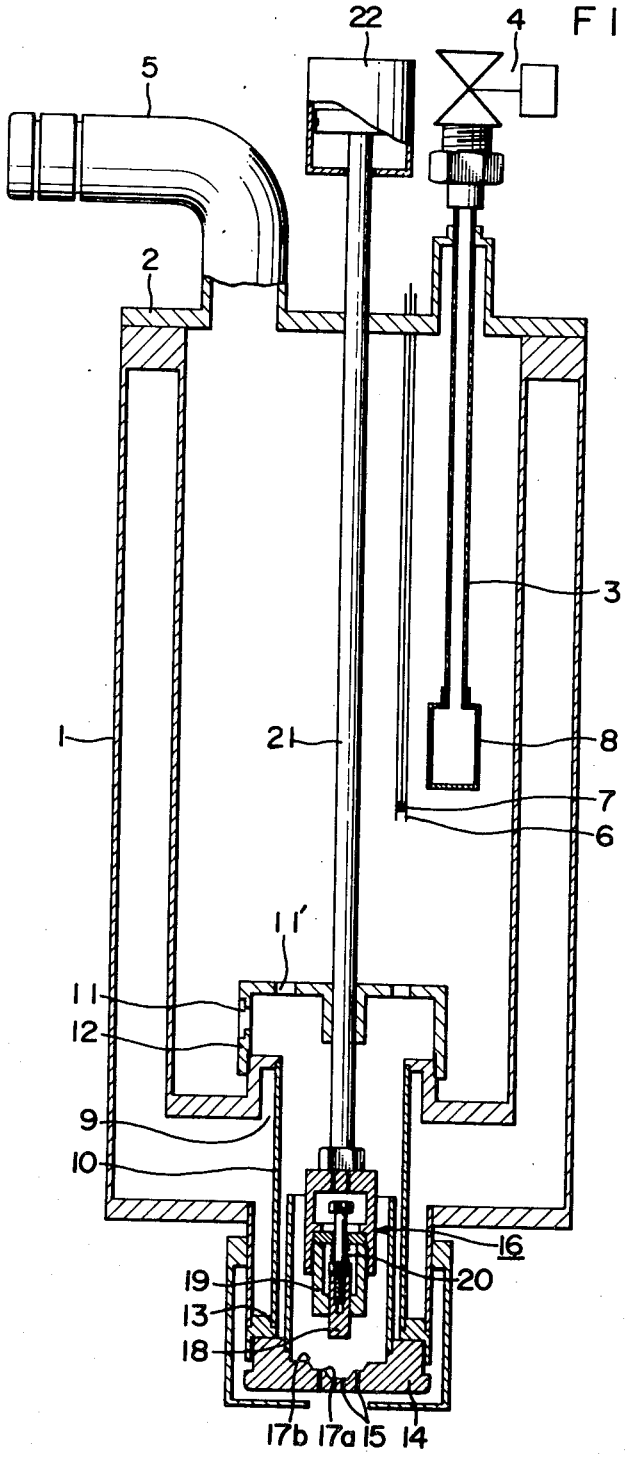
FIG. 1 is a vertically sectioned front view of a low-temperature liquefied gas outflow device according to an embodiment of the present invention.

Referring to FIG. 1, numeral 1 denotes a heat-insulating container which has an opening at the top and a double-walled structure over the remaining part. The space between the outer and inner walls is kept to vacuum. Numeral 2 denotes a cover member closing the opening of the container, and numeral 3 denotes a low-temperature liquefied gas supply conduit which is inserted into the container 1 through the cover member 2. Numeral 4 designates an electromagnetic check valve which is interposed between the supply conduit 3 and a low-temperature liquefied gas source (not shown), and numeral 5 designates a vaporized-gas exhaust conduit which is connected to the cover member 2 so as to communicate with the inside of the container 1 and is of a sufficient size. Numeral 6 designates a level sensor insertion tube inserted into the container 1 through the cover member 2, numeral 7 a level sensor provided within the level sensor insertion tube 6 which generates an output for controlling the electro-magnetic check valve 4, and numeral 8 a filter provided at the end of the liquefied gas supply conduit 3.

According to the present invention, in addition to the above structure an opening 9 is provided in the center of the base of the inner wall of the container 1, and the top of a cylindrical member 10 is fitted into the opening 9. This cylindrical member 10 has an opening in the top which is closed by a cap 12 which has an aperture 11 in its side surface and another aperture 11′ in its upper surface. An opening 13 is provided in the center of the base of the outer wall of the container 1, and the cylindrical member 10 also has a lower opening in its base. These openings are both closed by a liquefied gas outflow nozzle 14. The nozzle 14 has a plurality of through-holes 15 extending in the axial direction of the container 1, any desired number of which is made to open or close by a valve member 16.

With respect to the number of the through-holes provided in the nozzle 14, in the first embodiment illustrated in FIG. 1, for example, four through-holes 15 are arranged around the circumference of a single circle substantially in the center of the nozzle 14, and four through-holes 15 are arranged around the circumference of a single circle positioned outside the former circle concentrically therewith. An annular valve seat 17*a* is formed on the upper surface of the nozzle 14 at a position so as to surround the four central through-holes 15 and another annular valve seat 17*b* is formed so as to surround the four outer through-holes 15.

The valve member 16 includes two valve elements corresponding to the central through-holes and the outer through-holes, respectively. In more detail, one of the valve elements is an inner valve element 18 the lower surface of which is seated on the valve seat 17*a* so as to close the central through-holes 15. The other valve element is an outer valve element 19 which retains the inner valve element 18 slidably in the axial direction and its lower surface is seated on the valve seat 17*b* so as to close the outer through-holes 15. The valve member 16 further includes a compression spring 20 which is interposed between the upper surface of the inner valve element 18 and the upper part of the outer valve element 19 so as to force the inner valve element 18 to protrude constantly from the lower surface of the outer valve element 19; a piston rod 21 which is connected to the upper end of the outer valve element 19 and which extends upward through the cap 12 and cover member 2 in a liquid-and-air tight manner; and an elevation cylinder 22 for the piston rod 21.

In the low-temperature liquefied gas outflow device of the present invention having the above structure, the level of low-temperature liquefied gas in the heat-insulating container 1 is maintained constant by the operation of the electromagnetic check valve 4 which operates in response to signals from the level sensor 7. Further, the rate of flow of liquefied gas is maintained constant by the constant liquid level (head) and the constant diameter and number of through-holes 15 in the liquefied gas out-flow nozzle 14.

Any vaporized-gas produced in the heat-insulating container 1 and cylindrical member 10 is exhausted directly or through the aperture 11' and the vaporized-gas exhaust conduit 5 to the outside. Accordingly, the inside pressure of the container 1 can be maintained at a constant value, atmospheric pressure, thereby ensuring good conditions for the constant flow of liquefied gas.

One of the greatest advantages of the present invention is that not one but a plurality of through-holes 15 are formed in the nozzle 14. That is, the provision of a plurality of through-holes 15 means a reduction of the quantity of liquefied gas flowing through each through-hole 15. If the quantity of liquefied gas flow is sufficiently small, the shock of the collision of the liquefied gas against an object can be minimized sufficiently to reduce the rapid evaporation and scattering of the liquefied gas.

Further, by operating the elevation cylinder 22 so as to lower the piston rod 21 at a first step, the four through-holes 15 in the center of the nozzle 14 are closed by their contact with the inner valve element 18, thereby reducing the rate of flow of liquefied gas. If the piston rod 21 is lowered as far as its lowest position, the outer through-holes 15 are also closed by the outer valve element 19 in addition to the closing of the central through-holes.

The arrangement of the through-holes 15 can be modified, for example, to be in a grid pattern of two lines of two through-holes, two lines of three through-holes, three lines of four through-holes, etc.

As described in the foregoing, the low-temperature liquefied gas outflow device of the present invention is more advantageous than prior art outflow devices of this kind in that a selected quantity of low-temperature liquified gas can flow out accurately and constantly.

Figure 2:
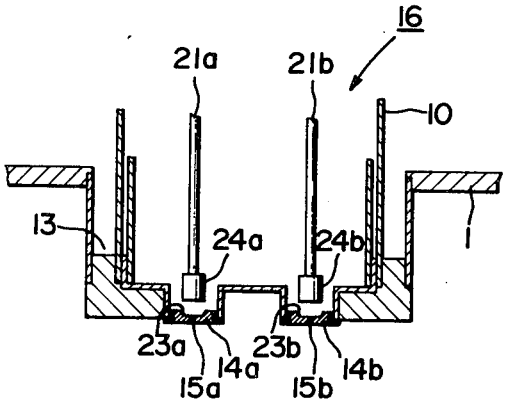
FIG. 2 is an explanatory view showing an important part of a low-temperature liquefied gas outflow device according to another embodiment of the present invention.

The description will now proceed to a second embodiment of the present invention, shown in FIG. 2, in which the liquefied gas outflow nozzle 14 comprises a pair of nozzle members 14*a* and 14*b* which are positioned separately in the horizontal direction. The nozzle members 14*a* and 14*b* have, for example, single through-holes 15*a* and 15*b* and single annular valve seats 23*a* and 23*b*, respectively. A pair of valve elements 24*a* and 24*b*, provided at the lower ends of a pair of piston rods 21*a* and 21*b* are positioned to face the corresponding valve seats 23*a* and 23*b*. These valve elements 24*a* and 24*b* are made to open or close the through-holes 15*a* and 15*b* by the operation of the piston rods 21*a* and 21*b*, respectively.

In this particular embodiment, the number of through-holes 15 to be opened can be varied as required from zero to two, thereby changing the flow rate of liquefied gas as desired.

Figure 3:
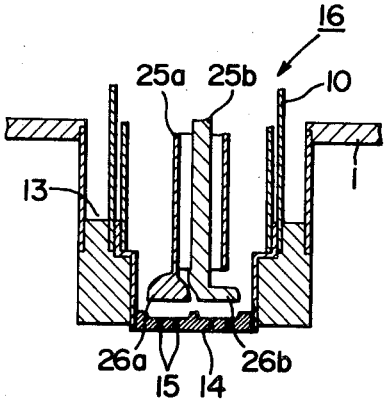
FIG. 3 is an explanatory view similar to FIG. 2 showing an important part of a low-temperature liquefied gas outflow device according to a third embodiment of the present invention.

Next, the low-temperature liquefied gas outflow device according to a third embodiment of the present invention will be explained. Referring to FIG. 3, a pair of concentric piston rods 25*a* and 25*b* are employed, having valve elements 26*a* and 26*b*, respectively at their lower ends which are arranged to be parallel. The number of through-holes 15 provided in the outflow nozzle 14 can be varied as desired by the operation of one or both of the piston rods 25*a* and 25*b*.

With these second and third embodiments, substantially the same effects can be obtained as those in the first embodiment.

What is claimed is:

1. A low-temperature liquefied gas outflow device comprising a heat-insulating container having an opening at the top, a cover member closing said opening, an outflow nozzle having a plurality of through-holes which extend through the base of said heat-insulating container, a control mechanism for selectively opening or closing any desired number of said plurality of through-holes provided in said outflow nozzle, said control mechanism comprising a plurality of valve elements within said heat-insulating container for selectively closing said through-holes, and an elevation cylinder for controlling the operation of said plurality of valve elements, a level sensor located within said heat-insulating container, a liquefied gas supply conduit extending through said cover member, a vaporized-gas exhaust conduit extending through said cover member, and a check valve inserted into said liquefied gas supply conduit, said check valve operating in response to a signal from said level sensor.

2. A low-temperature liquefied gas outflow device according to claim 1, wherein said plurality of valve elements are arranged concentrically with each other.

3. A low-temperature liquefied gas outflow device according to claim 1, wherein said plurality of valve elements are arranged separately in the horizontal direction from each other.

4. A device to provide an accurate and constant rate of flow of low-temperature liquefied gas comprising:

a heat-insulating container;

an outflow nozzle having a plurality of through-holes which extend axially through the bottom of said heat-insulating container and communicate with the inside of said heat-insulating container;

means for selectively opening or closing any desired number of said plurality of through-holes and comprising a plurality of movable valve elements located within said heat-insulating container above said through-holes and cooperable with said through-holes and means for moving said valve elements;

means for maintaining a constant level of low-temperature liquefied gas inside said heat-insulated container;

and means for exhausting vaporized-gas from inside said heat-insulated container to maintain the pressure inside said heat-insulated container constant.

5. A device according to claim 4 further comprising a tubular member extending upwardly from said nozzle inside said heat-insulating container and surrounding said plurality of through-holes and said movable valve elements, said tubular member having an aperture at its upper end for exhausting any vaporized-gas from inside said tubular member to said means for exhausting vaporized gs from inside said heat-insulated container.

6. A device according to claim 4 or 5 wherein said plurality of through-holes in said nozzle comprises at least two groups of through-holes, each group comprising at least one through-hole, and wherein said plurality of movable valve elements comprises at least two groups of valve elements, each group comprising at least one valve element, each group of valve elements being operatively associated with a group of through-holes whereby one group of through-holes can be open while another group is closed.

7. A device according to claim 6 wherein said means for moving said valve elements comprises at least one axially movable rod.

8. A device according to claim 6 wherein said one group of through-holes is located concentrically within the other group of through-holes in said nozzle, wherein said one group of valve elements comprises an inner valve member which is located concentrically within and is relatively movable axially with respect to said other group of valve elements.

9. A device according to claim 8 wherein said nozzle comprises a first annular valve seat surrounding said one group of through-holes and engageable with said inner valve member, and wherein said nozzle further comprises a second annular valve seat surrounding said other group of through-holes and said first annular valve seat and engageable with said outer valve member.

10. A device according to claim 9 wherein said means for moving said valve elements comprises at least one axially movable rod.

11. A device according to claim 6 wherein one group of through-holes is horizontally spaced apart from said other group of through-holes.

12. A device according to claim 11 wherein said means for moving said valve elements comprises at least one axially movable rod.

* * * * *